US007762625B2

(12) United States Patent
Hoffman et al.

(10) Patent No.: US 7,762,625 B2
(45) Date of Patent: Jul. 27, 2010

(54) RECLINING SEATING UNIT WITH HIGH LEGS AND T-SHAPED SEAT CUSHION

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 347 days.

(21) Appl. No.: 11/764,382

(22) Filed: Jun. 18, 2007

(65) Prior Publication Data

US 2008/0012396 A1 Jan. 17, 2008

Related U.S. Application Data

(60) Provisional application No. 60/819,831, filed on Jul. 11, 2006.

(51) Int. Cl.
*A47C 1/034* (2006.01)
*A47C 7/50* (2006.01)
*A47C 20/08* (2006.01)

(52) U.S. Cl. ..... 297/85 L; 297/85 R; 297/84; 297/423.26; 297/423.35

(58) Field of Classification Search ..... 297/88, 297/85, 69, 342, 423.28, 423.3, 423.34, 85 R, 297/75, 84, 423.26, 423.29, 85 L
See application file for complete search history.

(56) References Cited

U.S. PATENT DOCUMENTS 3,337,267 A * 8/1967 Rogers, Jr. ..... 297/322
3,522,969 A * 8/1970 Re ..... 297/85 R
4,212,494 A * 7/1980 Dabney ..... 297/69
4,270,796 A * 6/1981 Preston ..... 297/69
4,915,444 A 4/1990 Rogers, Jr.
5,013,084 A * 5/1991 May ..... 297/85 R
5,088,789 A * 2/1992 LaPointe et al. ..... 297/69
5,368,366 A * 11/1994 Mizelle ..... 297/423.3
6,540,291 B2 4/2003 Hoffman et al.
6,793,279 B2 * 9/2004 Hoffman et al. ..... 297/84
7,357,450 B2 * 4/2008 Rogers ..... 297/68
7,445,279 B2 * 11/2008 Crum ..... 297/84

* cited by examiner

*Primary Examiner*—Milton Nelson, Jr.
(74) *Attorney, Agent, or Firm*—Myers Bigel, Sibley & Sajovec

(57) ABSTRACT

A reclining seating unit includes: a frame configured to rest on an underlying surface; a generally horizontally-disposed seat; a generally upright backrest positioned rearwardly of the seat; a footrest unit; and a reclining mechanism that interconnects and controls the relative movement of the frame, the seat and the backrest between an upright position and a reclined position. In the upright position, the backrest is generally upright and positioned above the frame, and the seat has a first rearward position relative to the frame. In the reclined position, the backrest is reclined relative to the underlying surface as compared to its disposition in the upright position and the seat has a second forward position relative to the frame that is forward of the first rearward position. The footrest unit comprises at least one footrest and a footrest mechanism that interconnects the footrest with the seat. The footrest mechanism is configured to move the ottoman between a retracted position, in which the footrest is positioned beneath the seat, and an extended position, in which the footrest is generally horizontally disposed in front of the seat. When the backrest moves between the upright and reclined positions, the footrest unit moves in concert with the seat.

17 Claims, 6 Drawing Sheets

RECLINING SEATING UNIT WITH HIGH LEGS AND T-SHAPED SEAT CUSHION

RELATED APPLICATION

This application claims priority from U.S. Provisional Patent Application No. 60/819,831, filed Jul. 11, 2006 and entitled Press-Back Style Reclining Chair with Linear Actuator, the disclosure of which is hereby incorporated herein in its entirety.

FIELD OF THE INVENTION

The present invention relates generally to seating units, and more particularly to seating units with reclining capability.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest that provides support for the occupants feet in the reclined position.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor. In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr. and U.S. Pat. No. 6,540,291 to Hoffman, which illustrate chair of rather contemporary style with three-way reclining capability.

Nevertheless, some reclining mechanisms are not well-suited for certain chair styles. As an example, some reclining chairs have "T-shaped" cushions (often termed "T-cushions") that have laterally projecting wings positioned in front of the chair's arms. If the recliner chair is configured such that the seat moves rearward relative to the arms, the wings on the T-cushion can prevent the cushion from moving with the seat, such that the cushion is improperly positioned relative to the backrest when the backrest reclines.

As another example, some chairs have a "high leg" style in which the base of the chair is raised several inches off of the underlying surface (typically between about 2 and 7 inches). It is ordinarily undesirable for portions of a reclining mechanism to be visible in the space below the chair when the chair is in the upright position, so the designers are faced with providing a reclining mechanism that folds into a relatively small package.

It would be desirable to provide chairs that address some of these needs.

SUMMARY OF THE INVENTION

As a first aspect, embodiments of the present invention are directed to a reclining seating unit, comprising: a frame configured to rest on an underlying surface; a generally horizontally-disposed seat; a generally upright backrest positioned rearwardly of the seat; a footrest unit; and a reclining mechanism that interconnects and controls the relative movement of the frame, the seat and the backrest between an upright position and a reclined position. In the upright position, the backrest is generally upright and positioned above the frame, and the seat has a first rearward position relative to the frame. In the reclined position, the backrest is reclined relative to the underlying surface as compared to its disposition in the upright position and the seat has a second forward position relative to the frame that is forward of the first rearward position. The footrest unit comprises at least one footrest and a footrest mechanism that interconnects the footrest with the seat. The footrest mechanism is configured to move the ottoman between a retracted position, in which the footrest is positioned beneath the seat, and an extended position, in which the footrest is generally horizontally disposed in front of the seat. When the backrest moves between the upright and reclined positions, the footrest unit moves in concert with the seat.

As a second aspect, embodiments of the present invention are directed to a reclining seating unit, comprising: a frame configured to rest on an underlying surface; a generally horizontally-disposed seat that includes a T-cushion with laterally projecting wings, a generally upright backrest positioned rearwardly of the seat; a footrest unit; and a reclining mechanism that interconnects and controls the relative movement of the frame, the seat and the backrest between an upright position and a reclined position. In the upright position, the backrest is generally upright and positioned above the frame, and the seat has a first rearward position relative to the frame. In the reclined position, the backrest is reclined relative to the underlying surface as compared to its disposition in the upright position and the seat has a second forward position relative to the frame that is forward of the first rearward position. The footrest unit comprises at least one footrest and a footrest mechanism that interconnects the footrest with the seat. The footrest mechanism is configured to move the ottoman between a retracted position, in which the footrest is positioned beneath the seat, and an extended position, in which the footrest is generally horizontally disposed in front of the seat. The footrest mechanism is decoupled from the reclining mechanism. When the backrest moves between the upright and reclined positions, the footrest unit moves in concert with the seat.

As a third aspect, embodiments of the present invention are directed to a reclining seating unit, comprising: a frame configured to rest on an underlying surface; a generally horizontally-disposed seat; a generally upright backrest positioned rearwardly of the seat; a footrest unit; and a reclining mechanism that interconnects and controls the relative movement of the frame, the seat and the backrest between an upright position and a reclined position. In the upright position, the backrest is generally upright and positioned above the frame, and the seat has a first rearward position relative to the frame. In the reclined position, the backrest is reclined relative to the underlying surface as compared to its disposition in the upright position and the seat has a second forward position relative to the frame that is forward of the first rearward position. The footrest unit comprises at least one footrest and a footrest mechanism that interconnects the footrest with the seat. The footrest mechanism is configured to move the ottoman between a retracted position, in which the footrest is positioned beneath the seat, and an extended position, in which the footrest is generally horizontally disposed in front of the seat; the footrest mechanism being decoupled from the reclining mechanism. When the backrest moves between the upright and reclined positions, the footrest unit moves in concert with the seat. The seating unit further comprises front and rear legs configured to contact the underlying surface, the front and rear legs being mounted to the frame such that a lower portion of the frame clears the underlying surface by between about 2 and 7 inches.

DETAILED DESCRIPTION OF EMBODIMENTS OF THE INVENTION

Figure 1:
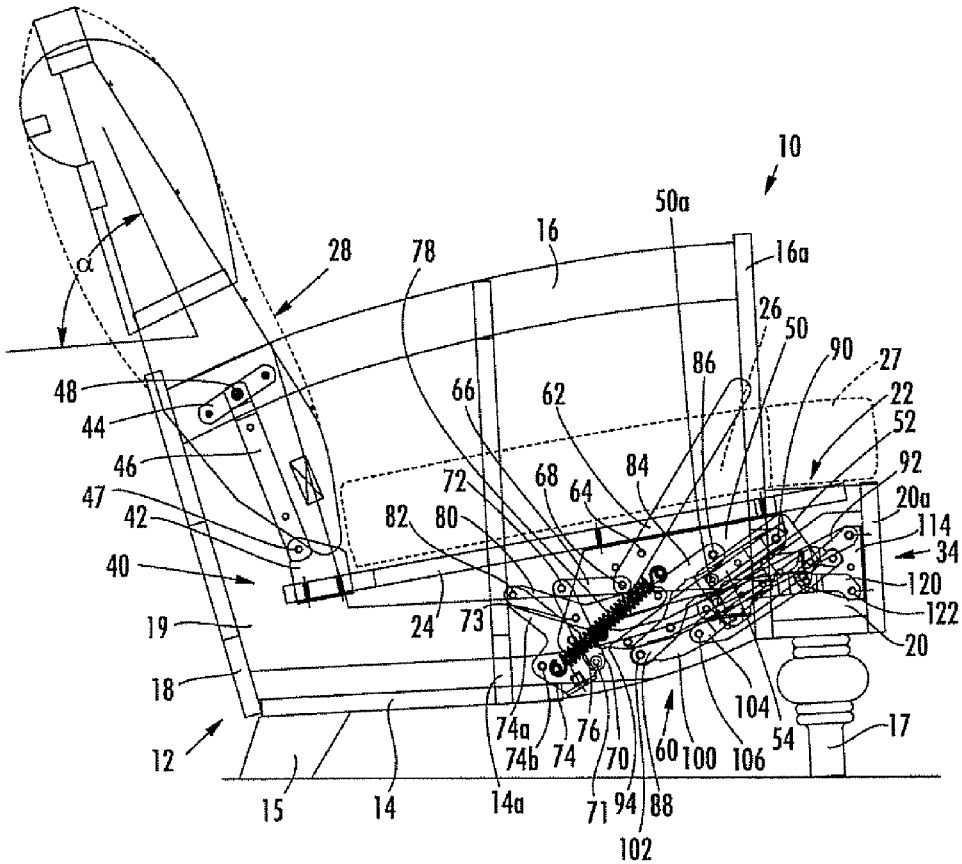
FIG. 1 is a cutaway side view of a reclining chair according to embodiments of the present invention, with the backrest in an upright position and the footrest in a retracted position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to the drawings, a chair, designated broadly at 10, is illustrated in FIGS. 1-6. The chair 10 includes a frame 12, a seat 22, a backrest 28, and a footrest unit 34. These components identified above are described in greater detail below. As used herein to describe the relative positions of components, the terms "lateral", "outward" and derivatives thereof indicate the directions defined by a vector beginning at a vertical plane P (shown in FIG. 5) that bisects the chair 10 normal to the seat 22 and the backrest 28 and extending normal thereto. Conversely, the terms "inward", "inboard" and derivatives thereof indicate the direction opposite the "outward" direction. Together, the "inward" and "outward" directions comprise the "transverse" axis of the chair 10. The "rear" of the chair 10 is located at the tip of the backrest 28, and the "front" of the chair 10 is located at the end of the seat 22 farthest from the backrest 28. The "front" and "rear" directions comprise the "longitudinal" axis of the chair 10.

Figure 6:
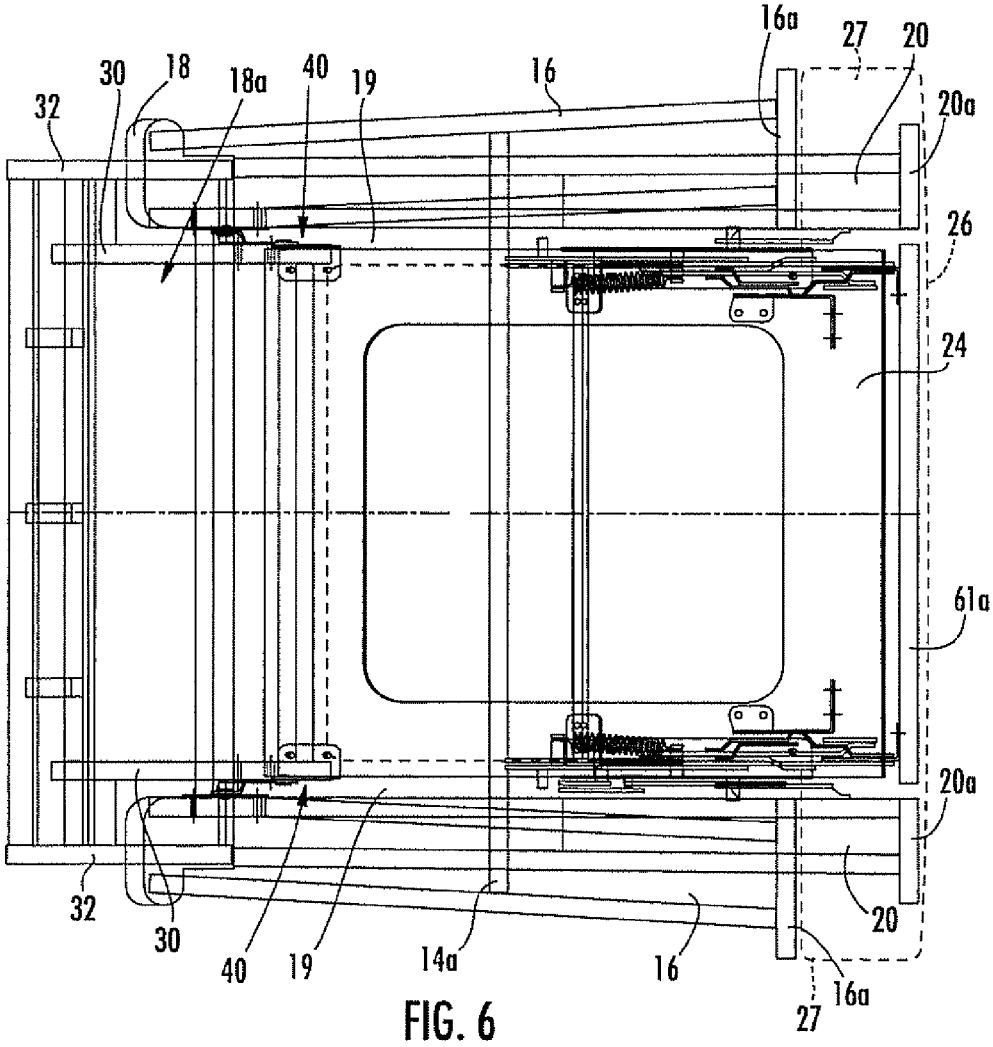
FIG. 6 is a cutaway top view of the reclining chair of FIG. 1 with the backrest in an upright position and the footrest in a retracted position.

Turning now to FIGS. 1 and 6, the frame 12 includes a generally horizontal base panel 14 to which are fixed arms 16, a cross-member 14*a*, and a rear panel 18. Rear legs 15 are fixed to the underside of the base panel 14. Each of the arms 16 is mounted to lateral portions of the base panel 14 and includes a front panel 16*a* that faces forwardly. The rear panel 18 is mounted to the rear edges of the base panel 14 and the arms 16 and includes a recess 18*a* within which the backrest 28 can recline. The frame 12 also includes an L-shaped mounting panel 19 fixed to the base panel 14 inward from each arm 16. Wings 20 are attached forwardly of the front panels 16*a* of the arms 16 and include front panels 20*a*. Front legs 17 are mounted below the wings 20. As a "high-leg"

chair, the legs 15, 17 typically enable the lowermost portion of the frame 12 to clear the floor by between about 2 and 7 inches.

Referring again to FIGS. 1 and 6, the seat 22 includes a seat panel 24 that is generally horizontally disposed between the arms 16, with a slight incline (typically between about 1 and 12 degrees) from rear to front. A T-shaped seat cushion 26 with wings 27 overlies the seat panel 24; the wings 27 overlie the wings 20 of the frame 12. The seat 22 is mounted to the frame 12 via a pair of reclining mechanisms 40, which are described in detail below.

Figure 5:
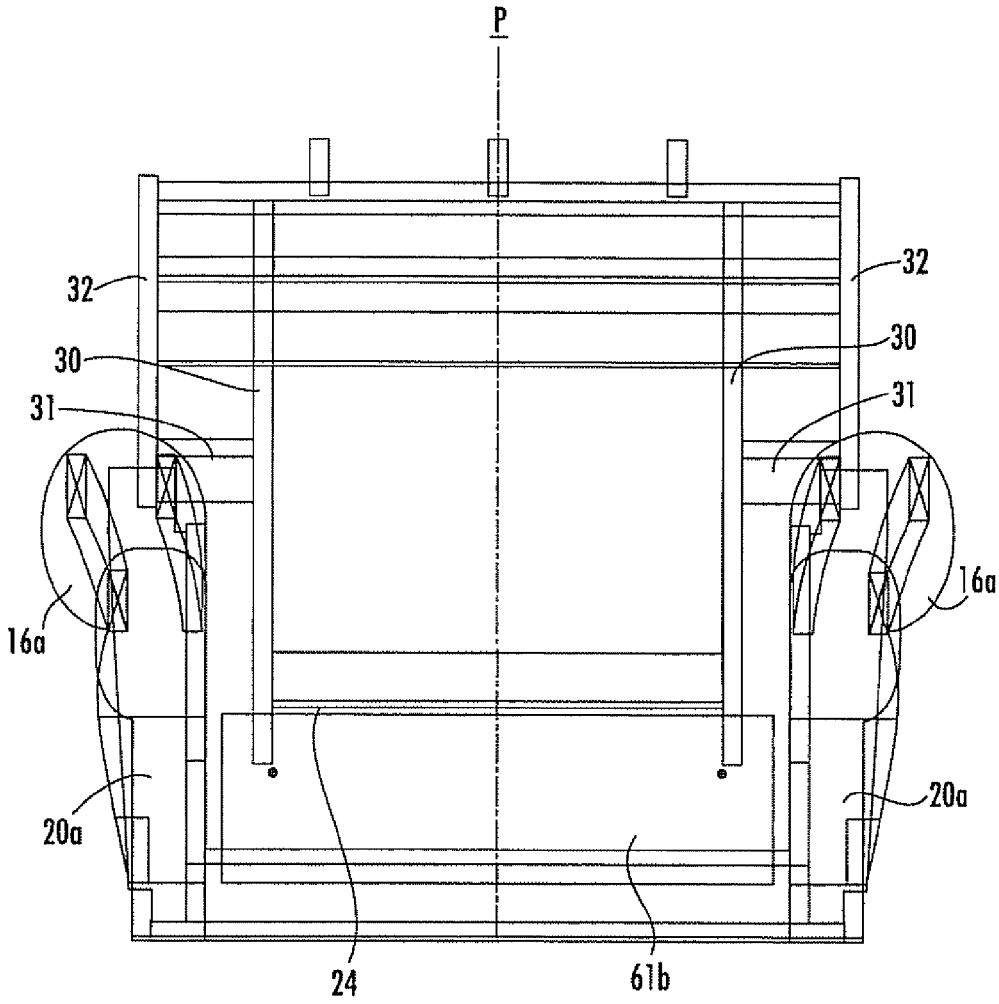
FIG. 5 is a cutaway front view of the reclining chair of FIG. 1 with the backrest in an upright position and the footrest in a retracted position.

The backrest 28 is disposed to be generally upright (with a typical angle $\alpha$ of between about 55 and 80 degrees to horizontal—see FIG. 1) above the rear portion of the frame 12. The backrest 28 includes an inner frame 30 that is attached to the reclining mechanism 40 and an outer frame 32 that is fixed to the inner frame 30 via a bridge 31 (FIG. 5).

The reclining mechanisms 40 mount the seat 22 and the backrest 28 to the frame 12 and move the backrest 28 between an upright position (FIGS. 1 and 3), in which the backrest 28 is generally upright and positioned above the rear portion of the seat 22, and a reclined position (FIGS. 2 and 4), in which the backrest 28 is reclined relative to the upright position. The reclining mechanisms 40 are mirror images of one another about the plane P; as such, only one reclining mechanism 40 is described herein, with the understanding that this discussion is equally applicable to the reclining mechanism on the opposite side of the chair 10. Also, the reclining mechanism 40 will be described first with respect to FIGS. 1 and 3, wherein the backrest 28 is in the upright position; a description of its movement to the reclined position (FIGS. 2 and 4) will then follow.

Figure 3:
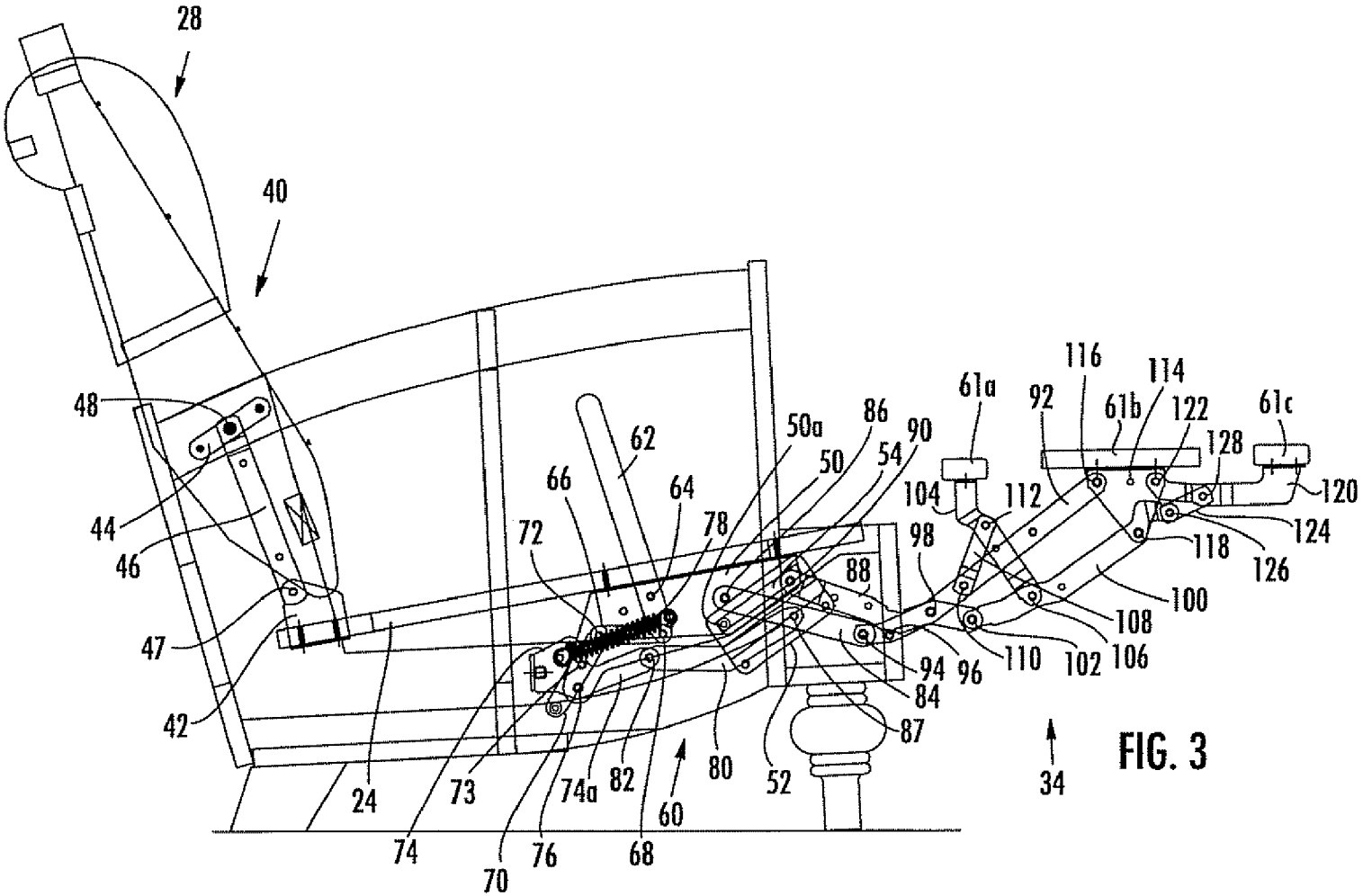
FIG. 3 is a cutaway side view of the reclining chair of FIG. 1 with the backrest in an upright position and the footrest in an extended position.

As can be seen in FIGS. 1 and 3, the reclining mechanism 40 includes a rear seat mounting bracket 42 that is mounted to the rear outer edge of the seat panel 24 and extends upwardly therefrom. A backrest mounting bracket 44 is fixed to the inner surface of the mounting panel 19 of the frame 12. A coupling link 46 is fixed to the inner frame 30 of the backrest 28. The coupling link 46 is pivotally attached to the backrest mounting bracket 44 at a pivot 48 and extends downwardly and slightly forwardly therefrom to attach to the rear seat mounting bracket 42 at a pivot 47.

Still referring to FIG. 3, a front seat mounting bracket 50 is fixed to a forward region of the underside of the seat panel 24 and extends downwardly therefrom. The front seat mounting bracket 50 includes a pin 50*a* on its outboard surface. A frame mounting bracket 52 is mounted to the inner surface of the mounting panel 19. The frame mounting bracket 52 includes a slot 54 that extends upwardly and forwardly and receives the pin 50*a* of the front seat mounting bracket 50. In the upright position shown in FIG. 3, the pin 50*a* is located at the rear end of the slot 54 and prevents rearward movement of the seat 22 relative to the frame 12; gravity prevents forward movement of the seat 22 and backrest 28 relative to the frame 12.

Figure 2:
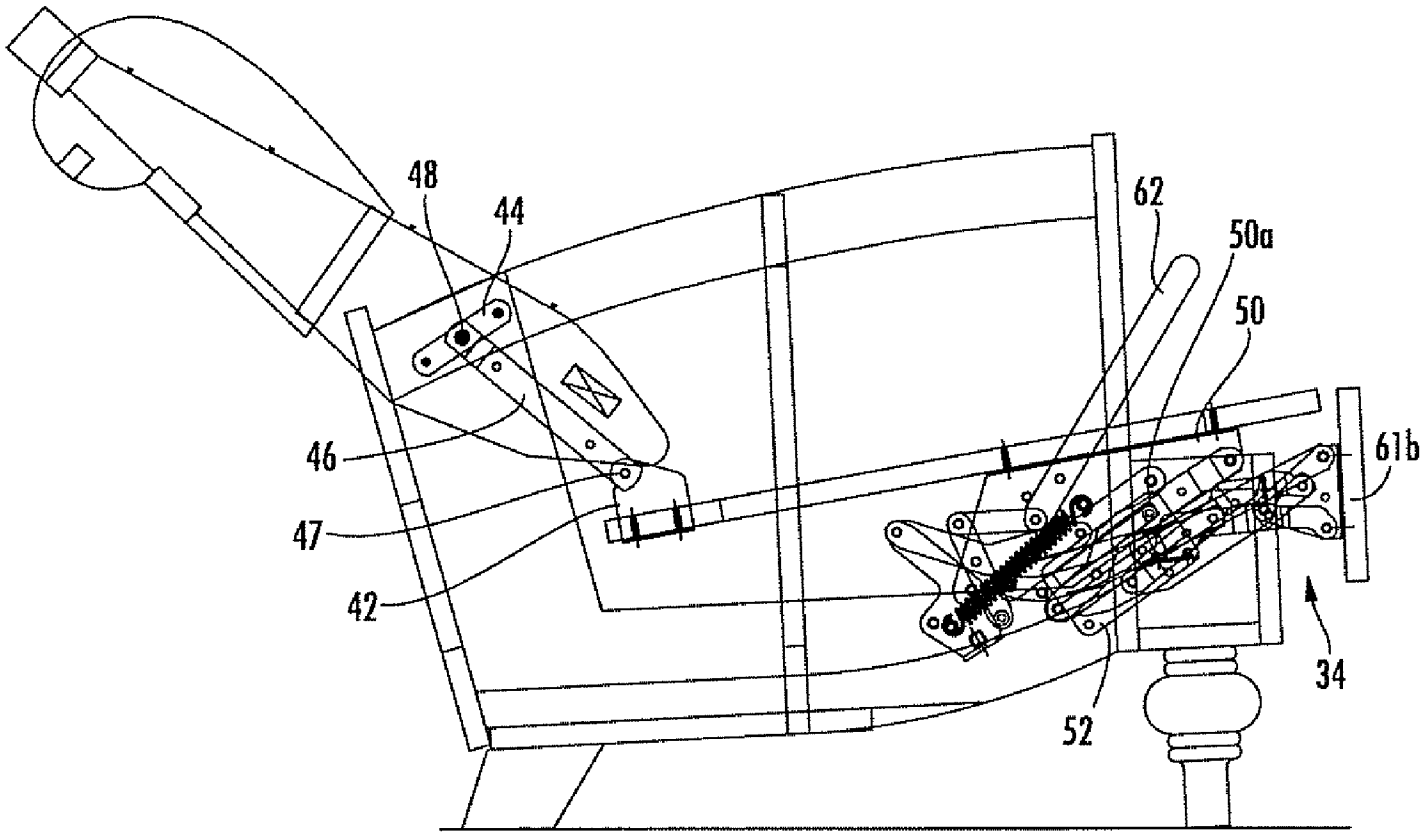
FIG. 2 is a cutaway side view of the reclining chair of FIG. 1 with the backrest in a reclined position and the footrest in a retracted position.
Figure 4:
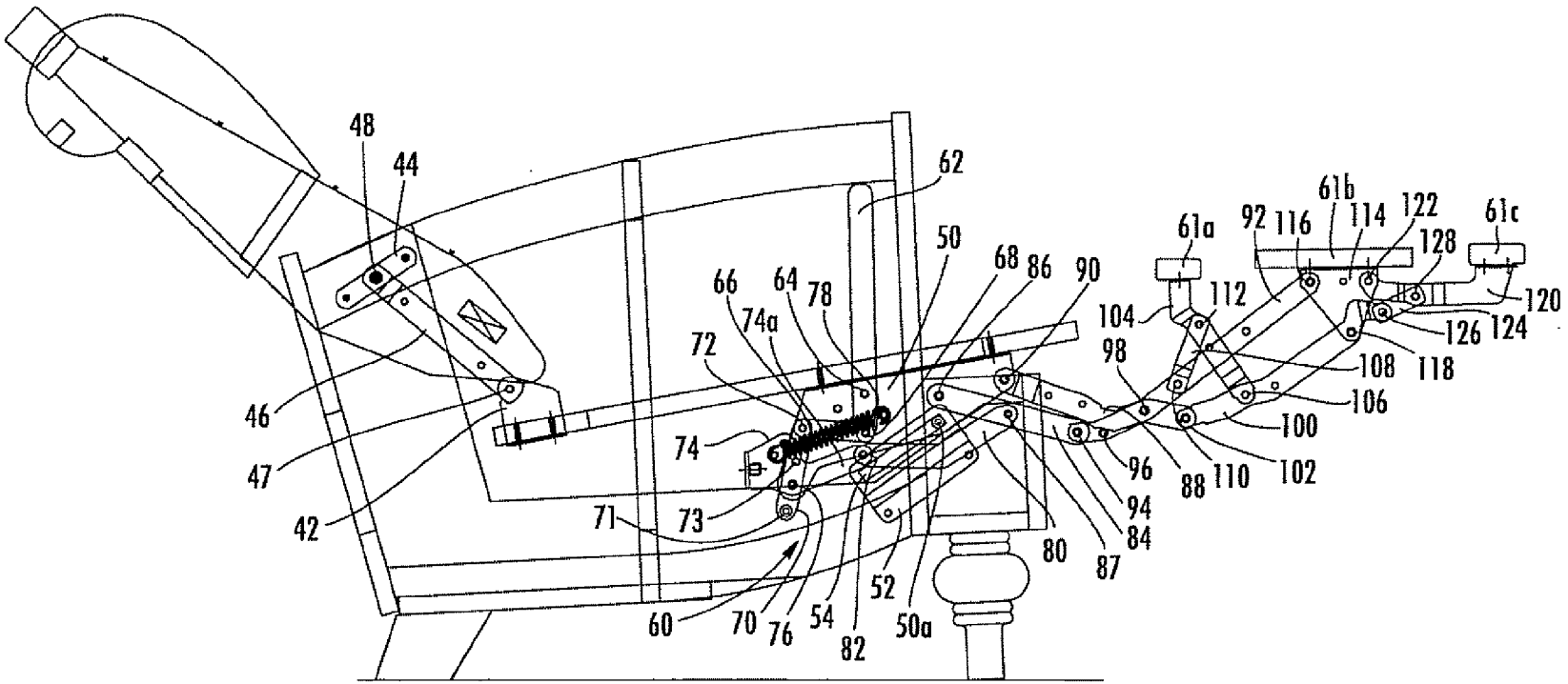
FIG. 4 is a cutaway side view of the reclining chair of FIG. 1 with the backrest in a reclined position and the footrest in an extended position.

In operation, the backrest 22 may be moved from the upright position of FIGS. 1 and 3 to the reclined position of FIGS. 2 and 4 through a forwardly-directed force applied to the backrest 28 (typically via an occupant of the chair 10 pushing rearwardly on the arms 16, such that the occupant's back is pressed into the upper end of the backrest 28). Such a force causes the backrest 28, and in turn the coupling link 46, to rotate (counterclockwise from the vantage point of FIGS. 1 and 3) about the pivot 48. The lower, forward end of the backrest 28 rises slightly and moves forwardly, and in doing so drives the rear seat mounting bracket 42 and, in turn, the seat 22 forwardly. The motion of the front end of the seat 22 follows the movement of the pin 50*a* as it moves forwardly in the slot 54. Motion ceases when the pin 50*a* reaches the forward end of the slot 54. Typically, the seat 22 moves forward between about 2.5 and 6 inches in moving from the upright position to the reclined position.

Notably, the backrest 28 and footrest unit are decoupled from each other, such that the backrest 28 is able to move to the reclined position independent of the position (i.e., retracted or extended) of the footrest mechanism 60. However, the entire footrest unit moves in concert with the seat 22 in either position.

The backrest 28 is maintained in the reclined position by the contact of the pin 50*a* with the front end of the slot 54. The backrest 28 can be returned to the upright position of FIGS. 1 and 3 by applying a rearwardly-directed force to the lower portion of the backrest 28 (typically by the occupant pressing his back against the lower portion of the backrest 28).

Turning now to FIG. 4, the footrest unit has two footrest mechanisms 60 that attach extendable footrest panels 61*a*, 61*b*, 61*c* to the frame 12. The footrest mechanisms 60 move the footrest panels 61*a*, 61*b*, 61*c* between retracted positions below a front portion of the seat 22 to extended positions in front of the seat 22. Like the reclining mechanism 40, the footrest mechanisms 60 are mirror images of each other about the plane P; consequently, only one of the footrest mechanisms 60 will be described herein, with the understanding that such description is applicable to the other footrest mechanism 60. For the sake of clarity, the footrest mechanism 60 will be described initially with respect to FIG. 4, in which the backrest 28 is in its reclined position and the footrest unit 34 is in its extended position.

The footrest mechanism 60 includes an actuating handle 62 that is attached to the seat mounting bracket 50 at a pivot 64. The graspable portion of the handle 62 extends generally upwardly therefrom and is located inboard of the adjacent arm 16. The lower portion of the handle 62 is pivotally attached to a drawing link 66 at a pivot 68. The drawing link 66 extends rearwardly from the pivot 68 to terminate in a pivot 72 with a crank 70. The crank 70 extends downwardly and rearwardly from the pivot 72 to a pivot 73 with the seat mounting bracket 50. The crank 70 includes a pin 71 on a portion thereof that extends below the pivot 73. A drive plate 74 is pivotally attached to the seat mounting plate 50 at a pivot 76. A finger 74*a* extends forwardly of the pivot 76. A spring 78 is attached between a rear portion of the drive plate 74 and the seat mounting bracket 50; the spring 78 is in tension.

A footrest drive link 80 is attached to the forward end of the finger 74*a* at a pivot 82 and extends generally forwardly and slightly upwardly therefrom. A lower footrest swing link 84 is attached to the seat mounting bracket 50 at a pivot 86 and extends generally forwardly therefrom, and an upper footrest swing link 88 is attached to the seat mounting bracket 50 at a pivot 90 that is positioned slightly upwardly and forwardly from the pivot 86 and extends generally forwardly therefrom. The footrest drive link 80 is attached to the lower footrest swing link 84 at a pivot 87. An upper footrest extension link 92 is attached to the forward end of the lower footrest swing link 84 at a pivot 94 and extends forwardly and upwardly therefrom. Similarly, a lower footrest extension link 100 is attached to the upper footrest swing link 88 at a pivot 102 and extends forwardly and upwardly therefrom. The upper footrest extension link 92 is also pivotally attached to the upper footrest swing link at a pivot 98. The upper footrest extension link 92 also includes a pin 96 between the pivots 94 and 98.

The footrest 61*a* is attached to the footrest mechanism 60 via a rear footrest link 104 that is pivotally attached to the lower footrest extension link 100 at a pivot 106 and extends upwardly and rearwardly therefrom to meet the footrest 61*a*.

A brace 108 is attached to the rear footrest link 104 at a pivot 112 and to the upper footrest extension link 92 at a pivot 110. The footrest 61*b* is mounted on a middle footrest bracket 114, which is attached to the upper and lower footrest extension links 92, 100 at pivots 116, 118 respectively. The footrest 61*c* is mounted to a front footrest link 120, which is attached to the middle footrest bracket 114 at a pivot 122 and extends forwardly therefrom to meet the footrest 61*c*. A brace 124 is attached to the front end of the lower footrest extension link 100 at a pivot 126 and to the front footrest link 120 at a pivot 128.

The footrests 61*a*, 61*b*, 61*c* of the chair 10 can be moved between their retracted positions (FIGS. 1 and 2) and their extended positions (FIGS. 3 and 4) through movement of the handle 62. Turning first to FIG. 1, it can be seen that the handle 62 extends upwardly and forwardly from the pivot 64. The drawing link 66 is generally horizontal and extends rearwardly from the pivot 68, and the crank 70 extends downwardly and forwardly from the pivot 72. The drive plate 74 is oriented such that the finger 74*a* points upwardly and rearwardly, and the footrest drive link 80 extends generally forwardly from the pivot 82. The upper and lower footrest swing links 88, 84 extend downwardly and rearwardly from their respective pivots 90, 86 with the seat mounting bracket 50, and the upper and lower footrest extension links 92, 100 extend upwardly and forwardly from, respectively, pivots 94, 102. The rear footrest link 104 extends upwardly and forwardly from the pivot 106, such that the footrest 61*a* is generally vertically disposed underneath the forward portion of the seat panel 24. The middle footrest bracket 114 is disposed such that the footrest 61*b* is vertically disposed and is substantially flush with the front panels 20*a* of the wings 20. The front footrest bracket 120 is extends rearwardly from the pivot 122, such that the footrest 61*c* is positioned below the forward portion of the seat panel 24 and faces downwardly. The footrest mechanism 60 is maintained in the retracted position by an "over-center" condition defined by the ends of the spring 78 and the pivot 76, wherein the spring 78 biases the footrest unit toward the retracted position.

To move the footrests 61*a*, 61*b*, 61*c* from their retracted positions shown in FIGS. 1 and 2 to their extended positions shown in FIGS. 3 and 4, an occupant of the chair 10 applies a rearwardly-directed force to the handle 62, which causes the handle 62 to rotate (counterclockwise from the vantage point of FIG. 1) about the pivot 64. This action pulls the drawing link 66 forward, which in turn draws the upper end of the crank 70 forward and rotates the crank 70 clockwise about the pivot 73. As the crank 70 rotates, the pin 71 contacts the forward edge of the drive plate 74 and forces the drive plate 74 to rotate clockwise about the pivot 76. This motion is encouraged by the tension in the spring 78 after the drive plate 74 rotates sufficiently that the over-center condition between the ends of the spring 78 and the pivot 76 no longer exists. Rotation of the drive plate 74 forces the finger 74*a* forward, which drives the footrest drive link 80 forward. Forward motion of the footrest drive link 80 rotates the lower footrest swing link 84 counterclockwise about the pivot 86, which action forces the upper footrest extension link 92 forward. The forward movement of the upper footrest extension link 92 rotates the upper footrest swing link 88 counterclockwise, which in turn drives the lower footrest extension link 100 forward.

The forward movement of the upper and lower footrest extension links 92, 100 unfolds the footrests 61*a*, 61*b*, 61*c*. More specifically, as the upper and lower footrest links 92, 100 move forwardly, the brace 108 rotates counterclockwise about the pivot 110, which action rotates the rear footrest link 104 counterclockwise about the pivot 106. This rotation raises the footrest 61*a* and rotates it counterclockwise to a generally horizontal disposition in front of the seat 22. The movement of the upper and lower footrest extension links 92, 100 also causes the middle footrest bracket 114 and the footrest 61*b* to rotate counterclockwise to a generally horizontal disposition in front of the footrest 61*a*. Finally, the movement of the upper and lower footrest extension links 92, 100 forces the brace 124 forward and rotates it counterclockwise about the pivot 126; this rotation causes the front footrest link 120 to rotate counterclockwise about the pivot 122 to an inverted position, such that the footrest 61*c* is generally horizontally disposed and positioned in front of the footrest 61*b*. Movement of the footrest mechanism 60 ceases when a pin 74*b* on the drive plate 74 strikes the rear edge of the seat mounting plate 50 and the pin 96 contacts the lower edge of the upper footrest swing link 88.

The footrests 61*a*, 61*b*, 61*c* can be moved back to the retracted position by the occupant pushing the handle 62 forward. As the handle 62 rotates clockwise about the pivot 64, the lower portion of the handle 62 forces the drawing link 66 rearwardly, which in turn rotates the crank 70 counterclockwise about the pivot 73. This movement, combined with the weight of the occupant's legs on the footrests 61*a*, 61*b*, 61*c*, overcomes the "over-center" condition created by the pivots 76, 82, 87, which releases the footrests 61*a*, 61*b*, 61*c* and allows them to collapse into their retracted positions (FIGS. 1 and 2).

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A reclining seating unit, comprising:

a frame mounted on legs configured to rest on an underlying surface;

a generally horizontally-disposed seat;

a generally upright backrest positioned rearwardly of the seat;

a footrest unit;

a reclining mechanism that interconnects and controls movement of the seat and the backrest relative to the frame between an upright position and a reclined position;

wherein in the upright position, the backrest is generally upright and positioned above the frame, and the seat has a first rearward position relative to the frame; and wherein in the reclined position, the backrest is reclined relative to the underlying surface as compared to its disposition in the upright position and the seat has a second forward position relative to the frame that is forward of the first rearward position;

the footrest unit comprising at least one footrest and a footrest mechanism that interconnects the footrest with the seat, the footrest mechanism configured to move the footrest between a retracted position, in which the footrest is positioned beneath the seat, and an extended position, in which the footrest is generally horizontally disposed in front of the seat, the footrest mechanism operating independently of the reclining mechanism;

wherein, when the backrest moves between the upright and reclined positions, the footrest unit moves in concert with the seat relative to the frame;

wherein the reclining mechanism includes:

a backrest mounting bracket fixed to the frame;

a coupling link pivotally attached to the backrest mounting bracket and fixed to the backrest;

a rear seat mounting bracket fixed to the seat and pivotally attached to the coupling link;

a frame mounting bracket fixed to the frame; and a front seat mounting bracket fixed to the seat and slidably attached to the frame mounting bracket.

2. The reclining seating unit defined in claim 1, wherein the at least one footrest is three footrests.

3. The reclining seating unit defined in claim 1, wherein the footrest unit includes an actuating handle attached to the seat.

4. The reclining seating unit defined in claim 3, wherein the frame includes arms on opposite sides thereof, and wherein the actuating handle is positioned inboard one of the arms.

5. The reclining seating unit defined in claim 1, wherein the footrest mechanism includes a spring that biases the footrest mechanism toward the retracted position when the footrest mechanism is in the retracted position.

6. The reclining seating unit defined in claim 1, wherein the legs are mounted to the frame such that a lowermost portion of the frame clears the underlying surface by between about 2 and 7 inches.

7. The reclining seating unit defined in claim 1, wherein the seating unit is a chair.

8. The reclining seating unit defined in claim 1, wherein the seat moves forward between about 2.5 and 6 inches when moving from the first rearward position to the second forward position.

9. The reclining seating unit defined in claim 1, wherein the seat includes a T-cushion with laterally projecting wings.

10. A reclining seating unit, comprising:

a frame mounted on legs configured to rest on an underlying surface;

a generally horizontally-disposed seat;

a generally upright backrest positioned rearwardly of the seat;

a footrest unit;

a reclining mechanism that interconnects and controls movement of the seat and the backrest relative to the frame between an upright position and a reclined position;

wherein in the upright position, the backrest is generally upright and positioned above the frame, and the seat has a first rearward position relative to the frame; and wherein in the reclined position, the backrest is reclined relative to the underlying surface as compared to its disposition in the upright position and the seat has a second forward position relative to the frame that is forward of the first rearward position;

the footrest unit comprising at least one footrest and a footrest mechanism that interconnects the footrest with the seat, the footrest mechanism configured to move the footrest between a retracted position, in which the footrest is positioned beneath the seat, and an extended position, in which the footrest is generally horizontally disposed in front of the seat; the footrest mechanism being decoupled from the reclining mechanism;

wherein, when the backrest moves between the upright and reclined positions, the footrest unit moves in concert with the seat; and further comprising front and rear legs configured to contact the underlying surface, the front and rear legs being mounted to the frame such that a lower portion of the frame clears the underlying surface by between about 2 and 7 inches.

11. The reclining seating unit defined in claim 10, wherein the seat moves forward between about 2.5 and 6 inches when moving from the first rearward position to the second forward position.

12. The reclining seating unit defined in claim 10, wherein the seat includes a T-cushion with laterally projecting wings.

13. The reclining seating unit defined in claim 10, wherein the seating unit is a chair.

14. The reclining seating unit defined in claim 10, wherein the at least one footrest is three footrests.

15. The reclining seating unit defined in claim 10, wherein the footrest unit includes an actuating handle attached to the seat.

16. The reclining seating unit defined in claim 15, wherein the frame includes arms on opposite sides thereof, and wherein the actuating handle is positioned inboard one of the arms.

17. The reclining seating unit defined in claim 10, wherein the footrest mechanism includes a spring that biases the footrest mechanism toward the retracted position when the footrest mechanism is in the retracted position.

* * * * *